United States Patent [19]

Gleaves

[11] Patent Number: 4,709,516

[45] Date of Patent: Dec. 1, 1987

[54] SELF-CLEANING GUTTER DEVICE

[75] Inventor: Geoffrey H. Gleaves, Hackensack, N.J.

[73] Assignee: Ropol, Inc., Mahwah, N.J.

[21] Appl. No.: 806,482

[22] Filed: Dec. 9, 1985

[51] Int. Cl.[4] ..... E04D 13/00

[52] U.S. Cl. ..... 52/11; 52/16

[58] Field of Search ..... 52/11–16; 209/913

[56] References Cited

U.S. PATENT DOCUMENTS

| | | | |
|---|---|---|---|
| 2,823,799 | 2/1958 | Gangell | 209/913 |
| 4,223,492 | 9/1980 | St. Clair | 52/157 |
| 4,241,547 | 12/1980 | Bové | 52/11 |

FOREIGN PATENT DOCUMENTS

| | | | |
|---|---|---|---|
| 128310 | 7/1948 | Australia | 52/11 |
| 122138 | 10/1978 | Japan | 52/11 |
| 1443432 | 7/1976 | United Kingdom | 210/111 |

*Primary Examiner*—Henry E. Raduazo

*Attorney, Agent, or Firm*—Salvatore C. Mitri

[57] ABSTRACT

There is disclosed a novel device for cleaning gutters that can be either power driven or manually operated. This device comprises an elongated, self-supporting, flexible member which is placed into and along the length of a gutter. When activated, this member causes debris within the gutter to be transported to a discharge outlet.

Also disclosed is a novel gutter having a configuration to receive and maximize the efficiency of operation of the self-cleaning gutter member.

2 Claims, 11 Drawing Figures

SELF-CLEANING GUTTER DEVICE

BACKGROUND OF THE INVENTION

Periodically cleaning out leaves, twigs and other debris that normally accumulate in gutters is typically a maintenance nuisance. For owners and occupiers of one, two and other multiple-family dwellings, this chore usually involves climbing up a ladder and manually removing such debris along the entire lenths of the gutters. Such an exercise involves risk and can even be dangeous. The accidents from falls off of ladders in attempts to complete this cleaning chore can result in sprains, broken limbs and other disabling injuries that are well documented in yearly statistics.

While placing protective screens over the open-topped gutters has reduced the frequency of such maintenance, it has not eliminated it nor the need to climb up a ladder and manually clean out the gutters. These protective screens are generally of large mesh size which eventually admit small or broken leaves, small twigs and other debris. Cleaning gutters equipped with such screens tends to increase the maintenance hazard as then, in addition to manually cleaning out the gutter, the protective screen has to be removed and then replaced. This often requires several more trips up and down a ladder.

SUMMARY OF THE INVENTION

This invention is directed toward a novel self-cleaning gutter device. This invention is also directed toward a novel gutter adapted to receive the self-cleaning gutter device.

In general, the novel, self-cleaning gutter device of the invention comprises: an elongated, self-supporting, flexible member capable of being placed within and along the length of a gutter; and, means for remotely activating said member such that debris collected in said gutter is transported along the length of said gutter to a discharge outlet.

Although the self-cleaning gutter device of the invention can be used with existing gutters, it is preferably used in combination with the novel gutter of the invention. In general, the novel gutter of the invention comprises: an elongated, open-topped member having vertically opposed, spaced apart upper side wall members each of which decline inwardly toward each other to define a wide angle, V-shaped area therebetween; and, a bottom bulbous or circular shaped section forming a gulley between and interconnecting the lower ends of said wide angle V-shaped area.

When used together, the novel, self-cleaning gutter device of the invention is placed in and along the length of the gulley section of the novel gutter such that the self-cleaning gutter device is housed in and restrained within the gulley portion of the gutter, but is free to perform its operation when activated.

Whether or not the self-cleaning gutter device of the invention is used with an existing gutter or the novel gutter of the inveniton, the gutters are adapted with means to remove debris from the gutter and, where appropriate, provide means for water to be discharged from the gutter.

Since the self-cleaning gutter device of the invention can be remotely activated by either power driven or manually operated means, the need to climb a ladder and manually clean out gutters is virtually eliminated as is the risk and danger connected with such manual cleaning.

DETAILED DESCRIPTION OF THE INVENTION

The self-cleaning gutter device and the novel gutter of the invenion will become more clear from the ensuing description when considered together with the accompanying drawing wherein like reference numerals denote like parts and wherein.

Figure 1:
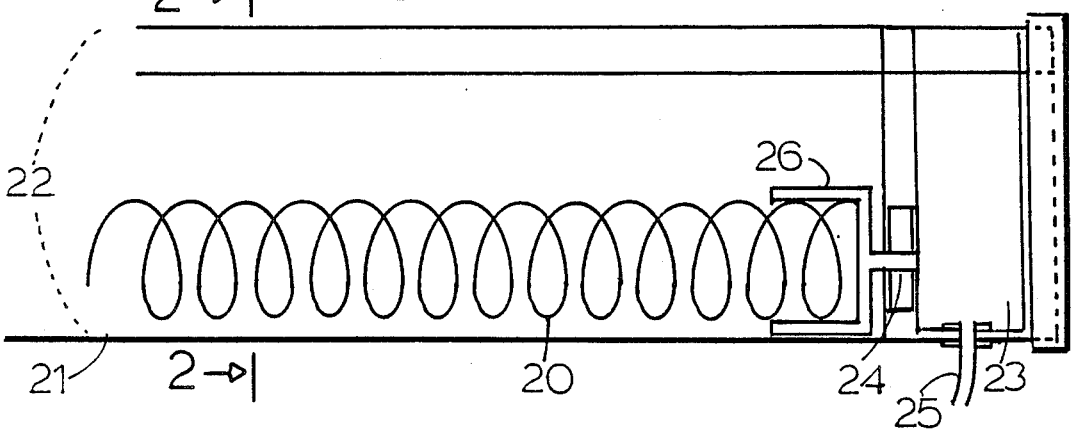
FIG. 1 is a side elevational view, part broken away for clarity, showing the self-cleaning gutter device of the invention positioned a conventional gutter of the invention.

As shown in FIG. 1, the self-cleaning device of the invention comprises an elongated, self-supporting, flexible member which is caused to vibrate or rotate within a gutter in such a manner as to convey debris collected in a gutter to an appropriate discharge outlet. In the embodiment shown in FIG. 1, the elongated, self-supporting, flexible member is in the form of an elongated helix or coil 20 which is positioned in and extends substantially along the length of the trough portion 21 of a conventional gutter 22 so that the longitudinal axis of flexible coil member 20 is coextensive with the length of the gutter trough 21.

Flexible coil member 21 can be caused to rotate about is longitudinal axis within gutter trough 21 by any conventional or suitable drive means such as an electric motor 23 which can be secured to or within one end of the gutter 22 and whose shaft 24 can be connected by conventional means to the adjacent end of flexible coil member 20 as shown in FIG. 1. Electric motor 23 can be plugged into a suitable electric outlet by means of electric cord 25 which can be equipped with its own on-off switch (not shown).

In a preferred embodiment, the end of flexible coil member 20 to be secured to the drive means; e.g., shaft 24, is encased in a reinforcing hub member 26 to impart to that end of flexible coil member 20 additional strength and rigidity. The end of flexible coil member 20 can be secured within hub member 26 by suitable conventional means or can be retained within hub member 26 by dimensioning the end of flexible coil member 20 so that it is biased against the inner circumferential wall of hub member 26.

When caused to rotate, such as by means of electric motor 23 through shaft 24, the rotation of flexible coil member 20 acts similar to that of a screw conveyor to advance and transport debris in gutter trough 21 to a suitable discharge outlet.

Figure 2:
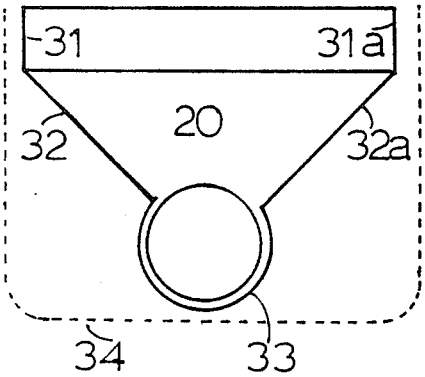
FIG. 2 is a view taken on the line 2—2 of FIG. 1.

To accommodate the flexible coil member 20 and maximize the efficiency of its operation, the novel gutter of the invention having the configuration shown more clearly in FIG. 2 is preferably employed. As shown in FIG. 2, the novel gutter, generally identified by reference numeral 30, comprises a unitary, open-topped structure having substantially vertically opposed spaced-apart side or wall members 31, 31*a*, each of which declines inwardly toward each other to define a wide angle V-shaped area therebetween, 32, 32*a*.

The lower ends of the V-shaped area 32, 32*a* are interconnected to form a bulbous or circular shaped gulley section 33 in which flexible coil member 20 is positioned and housed.

The configuration of gulley section 33 is such that flexible coil member 20 can be restrained within it, but is free to perform its operation when activated.

Novel gutter 30 and flexible coil member 20 can be of a size such that they can be placed as a separate unit within an existing gutter generally indicated in phantom by reference numeral 34 as shown in FIG. 2. It should be understood, however, that flexible coil memer 20 can also be of a size to be positioned within an existing gutter 34 by itself; i.e., without novel gutter 30.

Figure 3:
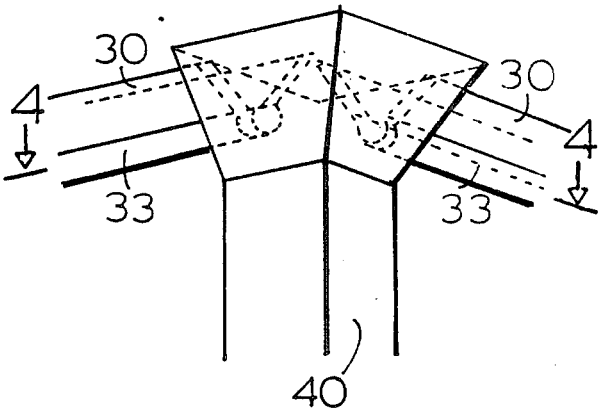
FIG. 3 is a perspective view showing portions of two intersecting gutter lengths and illustrating one means that can be used to discharge debris from a gutter employing the self-cleaning device of the invention.
Figure 4:
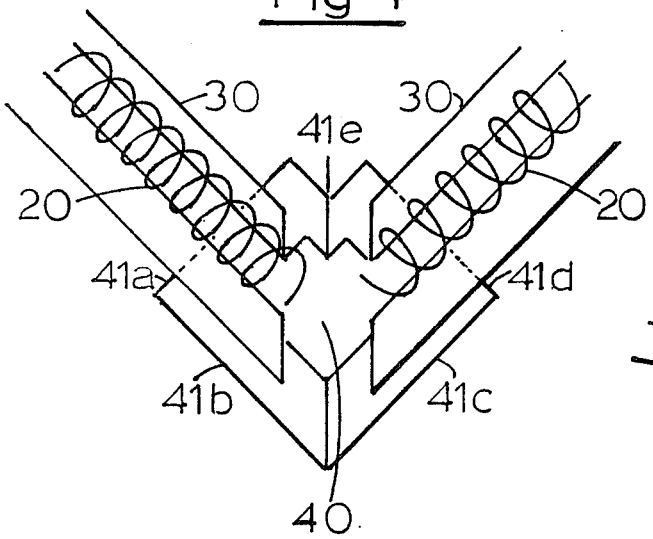
FIG. 4 is a view taken on the line 4—4 of FIG. 3.

FIGS. 3 and 4 illustrate one means by which debris transported by flexible coil member 20 can be discharged from gutter 30. As shown in FIGS. 3 and 4, this discharge means can comprise a chute member 40 having outwardly flared upper wall members 41*a*, 41*b*, 41*c* an 41*d* and corner section 41*e* so that chute member 40 can be positioned at the corner of a roof eave. Adjacent, outwardly flared wall members 41*a* and 41*d* can be adapted to receive and seat therein the ends of two intersecting gutter lengths so that debris transported by flexible coil member 20 can be discharged from gutter lengths 30 down chute 40 to a suitable receptable (not shown).

Figure 5:
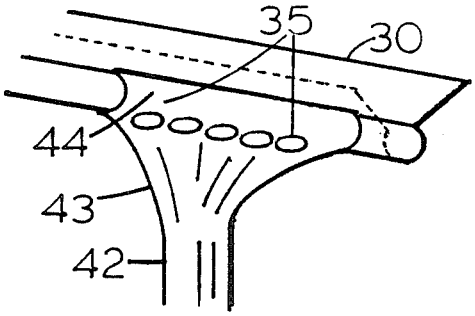
FIG. 5 is a perspective view, part broken away for clarity, showing a portion of a gutter length and illustrating one means that can be used to discharge water from a gutter employing the self-cleaning device of the invention.

In addition to or in place of using conventional down drain pipes to discharge water from gutter 30, FIG. 5 illustrates another means for discharging water from gutter 30. As shown in FIG. 5, a down drain pipe 42 is provided at its upper end with flared section 43 whose upper end 44 is shaped to fit over gulley section 33 of gutter 30. That portion of cirular section 33 that is common with the fitted upper end 44 of down drain pipe 42 contains a plurality of spaced apart apertures 35 through which water in gutter 30 can be discharged into and through down drain pipe 42.

For more efficient operation, the discharge means; e.g., chute member 40 (FIGS. 3 and 4), can be located at one end of gutter 30, the down drain pipe 42 at the opposite end of gutter 30 and the length of gutter 30 therebetween pitched toward down drain pipe 42. In this manner the flow of debris propelled by the flexible coil member 20 to be discharged can be counter to the gravity flow of water in the length of gutter 30 to be discharged through down drain pipe 42.

Figure 6:
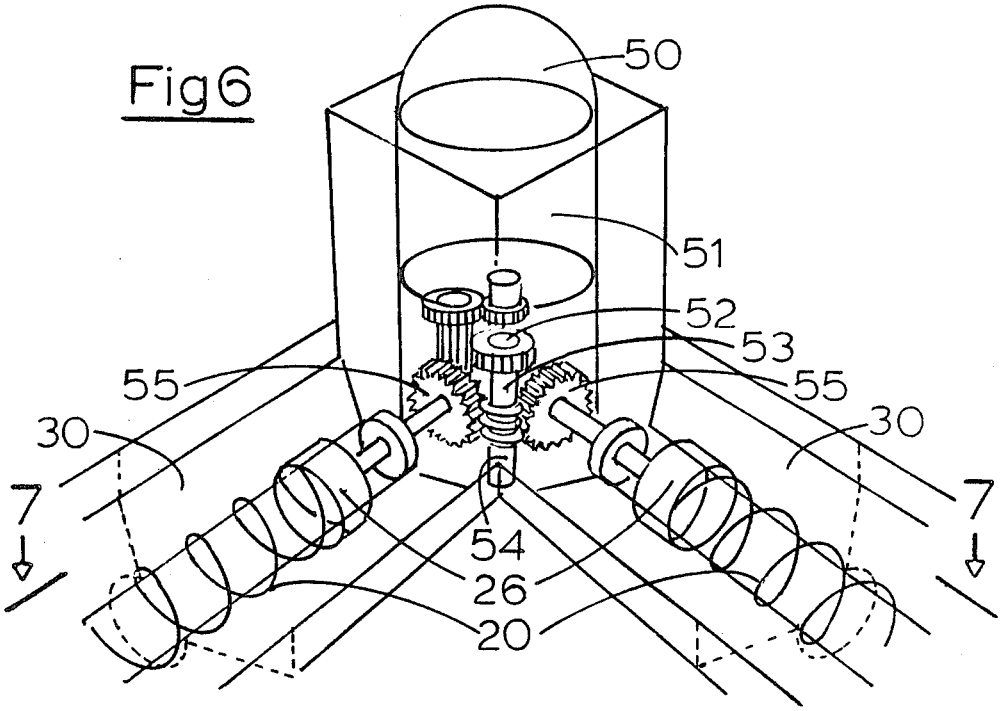
FIG. 6 is a perspective view, part broken away for clarity, showing portions of two intersecting gutter lengths in which the self-cleanig device of the invention is positioned and illustrating one means by which the self-cleaning device can be driven.
Figure 7:
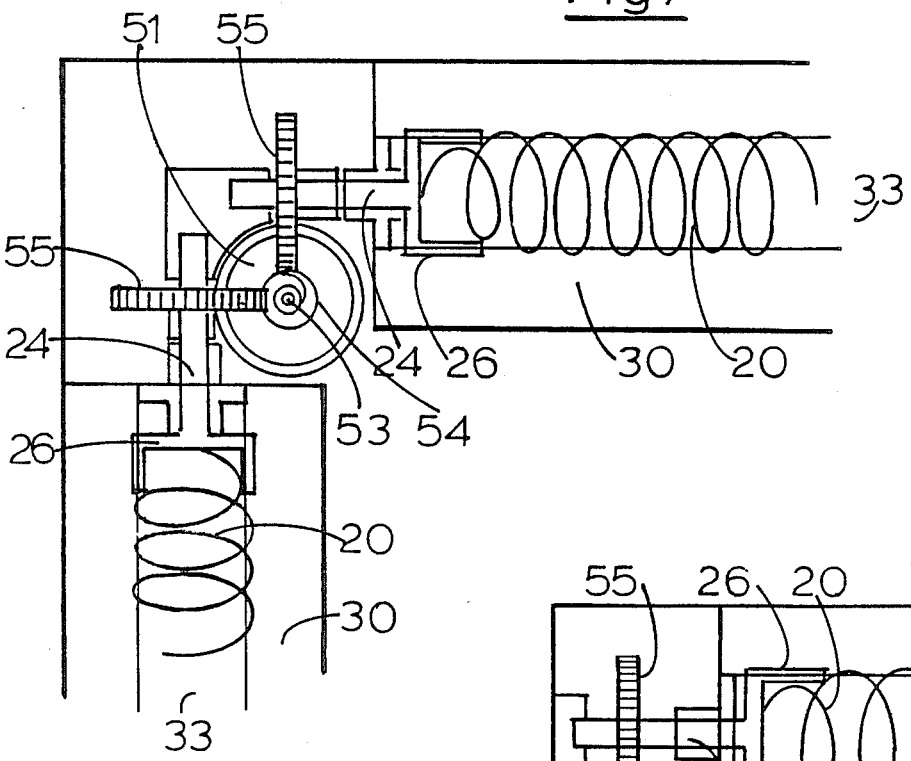
FIG. 7 is a view taken on the line 7—7 of FIG. 6.

One means by which the self-cleaning device of the invention can be driven is illustrated in the embodiment shown in FIGS. 6 and 7 wherein two intersecting flexible coil members 20 are driven by a common drive means generally indicated by reference numeral 50. In this embodiment, common drive means 50 comprises an electric motor 51 equipped with internal gears 52 to drive shaft 53. The lower end of shaft 53 terminates in a worm gear 54 positioned to intermesh with driven cog gears 55 whose shafts 24 can be secured either to hubs 26 or directly to flexible coil members 20.

Figure 8:
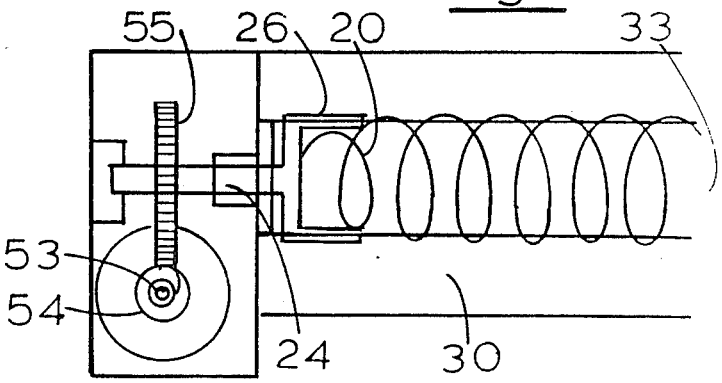
FIG. 8 is a plan view, part shown in phantom for clarity, illustrating a further means for driving the self-cleaning device of the invention.

FIG. 8 illustrates essentially the same type of assemblage as in FIGS. 6 and 7 except that the drive means 50 is positioned to drive a single flexible coil member 20. In FIG. 8, like reference numerals denote the same parts as shown in FIGS. 6 and 7 so that operation of the assemblage would be as described above for the assemblage shown in FIGS. 6 and 7.

Figure 9:
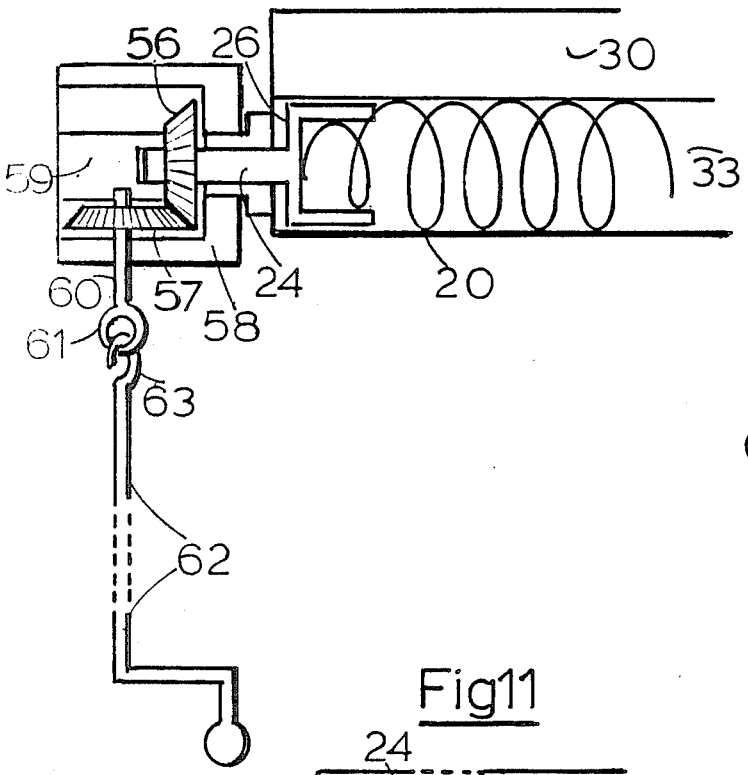
FIG. 9 is a side elevation view, part broken away and part shown in phantom for clarity, illustrating still another means for driving the self-cleaning device.

The embodiment shown in FIG. 9 is an assemblage for manually driving flexible coil member 20. As shown in FIG. 9, meshed bevel gears 56, 57 protected by and secured in housing 58 by gear hub 59 are connected either to hub 26 or flexible coil member 20 by shaft 24. The lower end of the shaft 60 of horizontal bevel gear 57 terminates in a loop 61 to receive the hook portion 63 in the upper end of crank 62. Rotation of crank 62 about its vertical axis results in rotating flexible coil member 20 through bevel gears 56, 57 and shafts 60 and 24.

Figure 10:
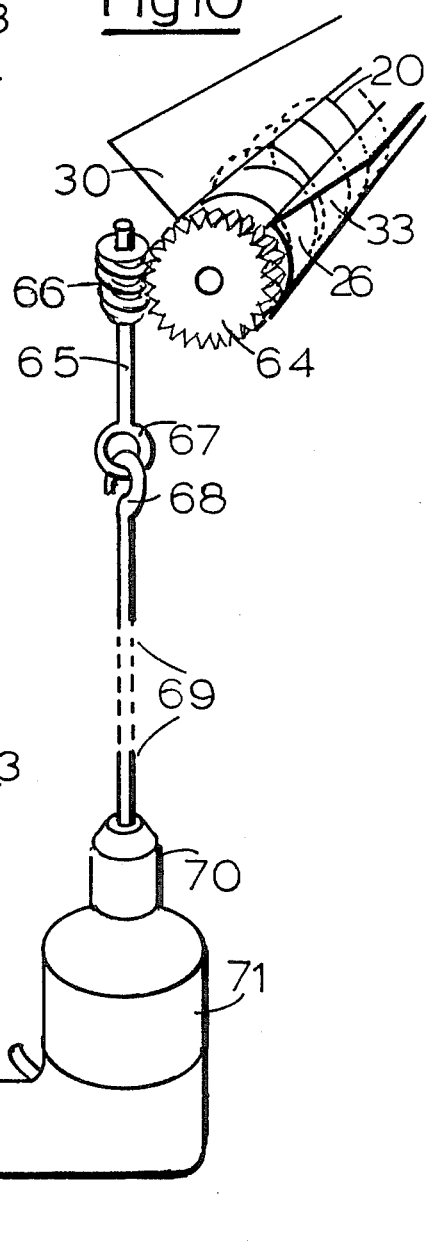
FIG. 10 is a perspective view, part broken away and part shown in phantom for clarity, illustrating a modification of the drive means shown in FIG. 9; and, FIG. 11 is a perspective view, part broken away and part shown in phantom, illustrating yet another means for driving the self-cleaning device of the invention.

FIG. 10 illustrates a modification of the assemblage shown in FIG. 9. In FIG. 10, cog gear 64 is positioned to mesh with worm gear 66 provided at the upper end of spindle 65. The loop 67 formed in the lower end of 65 receives hook portion 68 formed in the upper end of rod 69 whose opposite end is adapted to be fitted into the bit portion 70 of an electric drill 71. When drill 71 is turned on to rotate end 69 about its vertical axis, flexible coil member 20 is caused to rotate through rotation of spindle 65 which drives cog gear 64 by means of worm gear 66.

Figure 11:
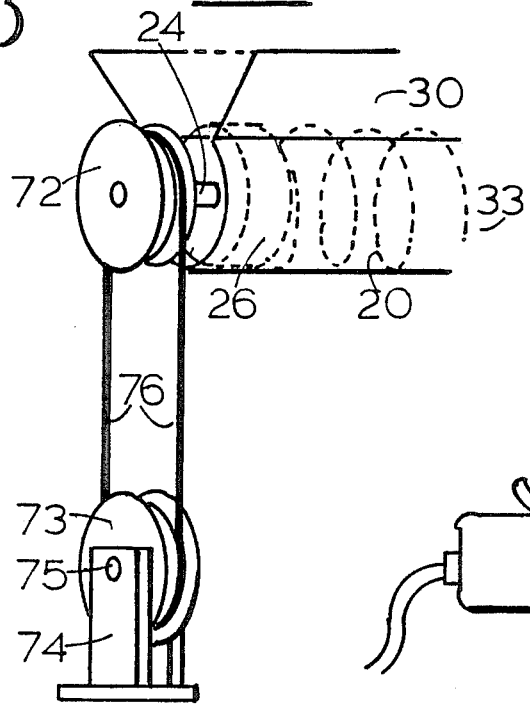

Another assemblage which can be employed to manually drive flexible coil member 20 is illustrated in FIG. 11. In this embodiment, shaft 24 is connected to a springed sheave 72 which is vertically aligned with a second springed sheave 73 located below sheave 72, preferably on the ground. Second springed sheave 73 is seated in and secured to mount means 74. Sheaves 72 and 73 are interconnected by means of endless belt 76 which is tensioned therebetween so that rotation of sheave 73 by pulling down on one side of endless belt 76 results in like rotation of sheave 72 and consequent rotation of flexible coil member 20.

What is claimed is:

1. A self-cleaning gutter device comprising:

an elongated, self-supporting flexible member capable of being placed within and along the length of a gutter; and;

means for remotely activating said flexible member such that debris in said gutter is transported by said flexible member along said gutter to a discharge outlet, said flexible member being in the form of an elongated helix or coil, one end of which is connected to said remote activating means by being fitted within a reinforcing hub such that said coil transports said debris in the manner of a screw conveyor.

2. The combination of a gutter and a self-cleaning gutter device comprising:

an elongated, open-topped gutter member having opposed, spaced-apart side walls each of which decline inwardly toward each other to define a wide angle V-shaped area therebetween;

a bulbous or circular shaped section forming a gulley between and interconnecting the lower ends of said wide angle, V-shaped area;

means for removing water from said gutter;

outlet means associated with said gutter through which debris collected therein can be discharged therefrom;

an elongated, self-supporting flexible member capable of being placed within and along the length of said gulley section such that said flexible member is housed and restrained within said gulley section without interferring with the operation of said flexible member; and, p1 means for remotely activating said flexible member such that debris collected in said gutter member is transported by said flexible member to said outlet discharge means, said flexible member being in the form of an elongated helix or coil, one end of which is connected to said remote activating means by being fitted within a reinforcing hub such that said coil transports said debris in the manner of a screw conveyor.

* * * * *